US008152038B2

(12) United States Patent
Rouger et al.

(10) Patent No.: US 8,152,038 B2
(45) Date of Patent: Apr. 10, 2012

(54) NOSE ASSEMBLY FOR A FASTENER DRIVING TOOL

(75) Inventors: Claire Rouger, Evanston, IL (US); Kyle Kestner, Schaumburg, IL (US); Ken Dobson, Chicago, IL (US); Mike Popovich, Bartlett, IL (US)

(73) Assignee: Illinois Tool Works Inc., Glenview, IL (US)

( * ) Notice: Subject to any disclaimer, the term of this patent is extended or adjusted under 35 U.S.C. 154(b) by 155 days.

(21) Appl. No.: 11/725,122

(22) Filed: Mar. 16, 2007

(65) Prior Publication Data

US 2008/0223898 A1 Sep. 18, 2008

(51) Int. Cl.
*B25C 5/00* (2006.01)
*B25C 1/02* (2006.01)

(52) U.S. Cl. ..... 227/10; 227/8; 227/119

(58) Field of Classification Search ..... 227/8, 10, 227/119, 120, 130
See application file for complete search history.

(56) References Cited

U.S. PATENT DOCUMENTS 3,504,840 A * 4/1970 Wandel et al. ..... 227/130
3,708,095 A * 1/1973 Briggs, Jr. ..... 227/126
3,820,705 A * 6/1974 Beals ..... 227/113
3,893,610 A * 7/1975 Smith ..... 227/8
3,973,605 A * 8/1976 DeCaro ..... 81/431
4,405,071 A * 9/1983 Austin ..... 227/7
4,809,568 A * 3/1989 DeCaro ..... 81/57.37
5,197,646 A * 3/1993 Nikolich ..... 227/8
5,238,167 A * 8/1993 Howard et al. ..... 227/110
5,320,268 A * 6/1994 Shkolnikov et al. ..... 227/66
5,517,883 A * 5/1996 Goldi et al. ..... 81/57.37
5,593,079 A * 1/1997 Mukoyama et al. ..... 227/130
5,653,371 A * 8/1997 Hou ..... 227/109
5,943,926 A * 8/1999 Habermehl ..... 81/434
5,996,875 A * 12/1999 Clark et al. ..... 227/10
6,138,887 A * 10/2000 Nayrac et al. ..... 227/8
6,161,746 A * 12/2000 Wey ..... 227/109
6,164,510 A 12/2000 Deieso et al.
6,296,167 B1 * 10/2001 Jen ..... 227/120
6,398,097 B1 * 6/2002 Liang ..... 227/109
6,499,642 B1 * 12/2002 Amada ..... 227/119
6,520,397 B1 * 2/2003 Moeller ..... 227/130
6,626,345 B2 * 9/2003 Amada ..... 227/120
6,641,021 B2 11/2003 Jablonski
6,884,012 B2 4/2005 Panasik
6,892,922 B2 5/2005 Tucker et al.
6,908,021 B1 * 6/2005 Wang ..... 227/8
6,941,847 B2 * 9/2005 Habermehl et al. ..... 81/434
6,966,477 B1 * 11/2005 Chien-Kuo et al. ..... 227/8
7,040,521 B2 5/2006 Kolodziej et al.

(Continued)

*Primary Examiner* — Thanh Truong
*Assistant Examiner* — Gloria R Weeks
(74) *Attorney, Agent, or Firm* — Greer, Burns & Crain, Ltd.; Patty Chidiac; Mark W. Croll

(57) ABSTRACT

In a fastener-driving tool equipped with a fastener magazine, and a power source including a reciprocating driver blade for driving fasteners obtained from the magazine into a workpiece, and a reciprocating valve sleeve actuated by a cage, a nosepiece is provided, including a nosepiece body configured for attachment at one end to the fastener tool and defining a fastener channel constructed and arranged for receiving the driver blade and the fasteners sequentially fed by the magazine, the fastener channel having a fastener outlet. A tubular pin guide is disposed for reciprocal movement in the fastener channel for receiving fasteners traveling toward the outlet. A unitary actuator has a first end engaging the pin guide for common reciprocation relative to the nosepiece body and a second end engaging the cage.

13 Claims, 5 Drawing Sheets

U.S. PATENT DOCUMENTS

| | | | | |
|---|---|---|---|---|
| 7,097,083 | B2 | 8/2006 | Kolodziej et al. | |
| 7,273,160 | B2 * | 9/2007 | Wey | 227/125 |
| 7,303,103 | B2 * | 12/2007 | Wang | 227/8 |
| 7,410,084 | B1 * | 8/2008 | Reed | 227/119 |
| 2004/0050897 | A1 * | 3/2004 | Popovich et al. | 227/10 |
| 2005/0150929 | A1 * | 7/2005 | Wey | 227/120 |
| 2006/0011693 | A1 * | 1/2006 | Wywialowski et al. | 227/109 |
| 2007/0194077 | A1 * | 8/2007 | Lee | 227/8 |

* cited by examiner

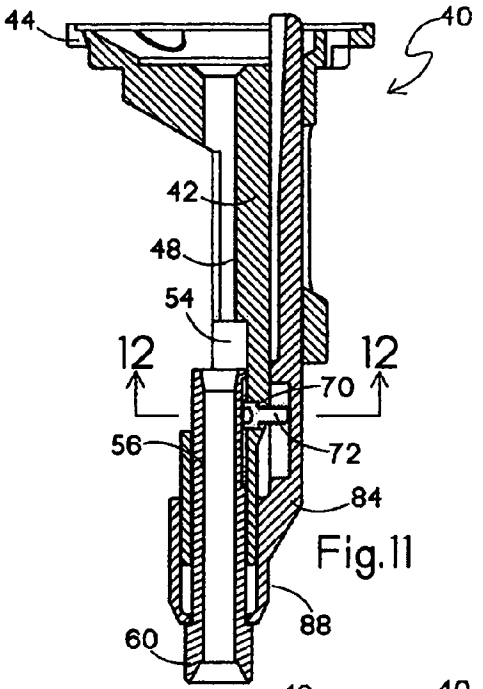
Fig.7
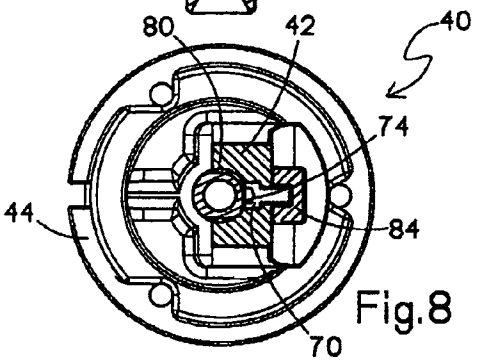
Fig.8
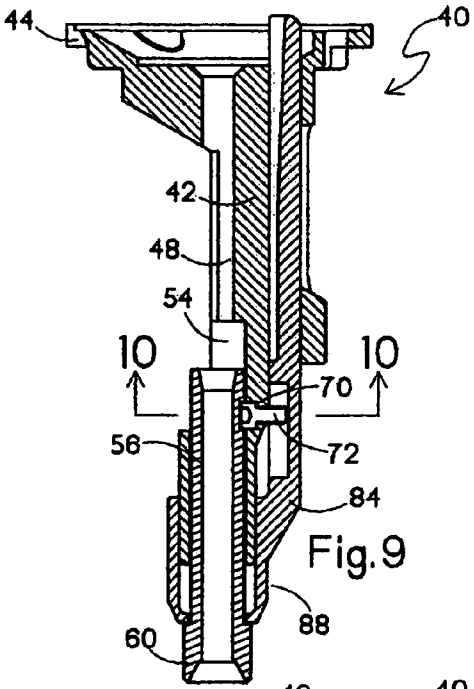
Fig.9
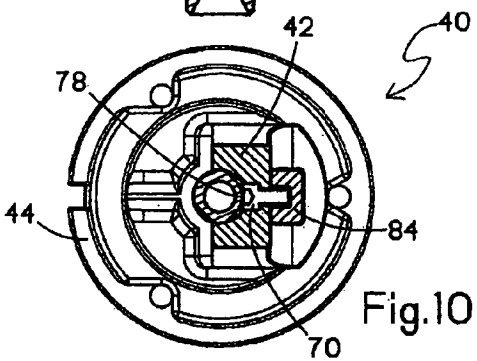
Fig.10
Fig.11
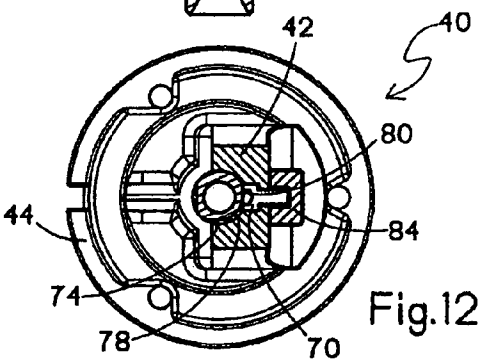
Fig.12

NOSE ASSEMBLY FOR A FASTENER DRIVING TOOL

BACKGROUND

The present invention relates generally to portable fastener driving tools. More specifically, embodiments of the present invention relate to nose assemblies for such tools.

Portable fastener driving tools are typically powered by pneumatic, combustion, electric, or powder systems, and nose assemblies according to embodiments of the present invention are contemplated for use on portable fastener driving tools regardless of the power system. However, exemplary embodiments described herein will refer to combustion-powered tools.

Portable combustion-powered fastener driving tools, such as those manufactured by ITW Paslode under the IMPULSE® brand, and those manufactured by ITW Ramset under the TRAKFAST® brand, are utilized for driving fasteners into workpieces or substrates. Examples of portable combustion-powered fastener driving tools are described in commonly-assigned U.S. Pat. No. 6,164,510, the contents of which are incorporated by reference.

Such tools incorporate a tool housing enclosing a small internal combustion engine. The engine is powered by a canister of pressurized fuel gas called a fuel cell. A battery-powered electronic power control unit produces the spark for ignition. A fan located in a combustion chamber both provides for an efficient combustion within the chamber and facilitates scavenging, including the exhaust of combustion by-products.

The engine includes a reciprocating piston having an elongate, rigid driver blade reciprocating inside a cylinder. A valve sleeve is axially reciprocal about the cylinder and, through a linkage, moves to close the combustion chamber when a work contact element (WCE) at the end of the linkage is pressed against a workpiece or substrate. This pressing action also triggers a fuel metering valve to introduce a specified volume of fuel into the closed combustion chamber.

Upon the pulling of a trigger switch, which causes the ignition of a gas/air mixture in the combustion chamber, the piston and driver blade are driven down the sleeve. Fasteners are fed to a nosepiece from a magazine where they are held in a properly positioned orientation for receiving the impact of the driver blade. A leading end of the driver blade engages a fastener and drives it along a channel defined by the nosepiece into the substrate. The channel is defined by upper and lower guide members of the nosepiece. Next, the piston and driver blade are returned to the original, pre-firing ("ready") position by differential gas pressures within the cylinder.

The nosepiece and WCE typically includes a number of precision parts, forming and assembly of which can add significantly to the cost of tool production, operation and maintenance. It is desired for these parts to be formed and assembled precisely, for example, to ensure proper alignment and provide a clear path for the driver blade and fastener. Otherwise, jamming of the fastener may result.

Fasteners used with such fastener driving tools include nails designed to be forcibly driven into wood and drive pins designed to be forcibly driven into concrete or masonry. Typically, in such drive pins, the shank has a portion flaring outwardly where the shank adjoins the head. An exemplary use of such drive pins is for attaching metal channels, which are used to mount plasterboard walls, or other metal workpieces to concrete substrates.

Many fastener-driving tools require such fasteners to be fed in strips, in which the fasteners are collated, through magazines having mechanisms for feeding the strips of collated fasteners. Commonly, such fasteners are collated via carriers molded from polymeric materials, such as polypropylene, with individual sleeves, bushings, or holders for the respective fasteners, and with frangible bridges between successive sleeves, bushings or holders.

Specifically, conventional fastener tool nosepieces of the type used with such collated fasteners or drive pins are disclosed in U.S. Pat. No. 6,641,021, which is incorporated by reference, typically include a tubular WCE which extends upward into the nosepiece and includes a laterally opening slot for sequentially receiving collated pins fed from a magazine. In some cases, pins or the molded sleeves carrying the pins become misaligned in the slot and subsequently jam in the WCE.

Additionally, these types of fastener driving tools absorb considerable shock and vibration during and after each actuation (firing). Further, the impact forces generated after fastener driving cause the tool to be propelled away from the fastener as it is driven into the workpiece/substrate. Recently, framing tools have become more powerful to satisfy operator needs. These enhanced forces put large stresses on many parts of the tool, which may cause more rapid wear of the nosepiece and/or the WCE. Extended wear to the nosepiece also may cause the tubular WCE to break or warp. Besides the cost of repair, such malfunctions result in tool downtime, which is exacerbated by the relatively complex nosepiece assembly.

Thus, there is a need for an improved nose assembly for a portable fastener driving tool that addresses one or more of the above-identified design issues of production and assembly cost, required precision for assembly, and maintenance and repair costs.

BRIEF SUMMARY OF THE INVENTION

The above-listed needs are met or exceeded by the present nose assembly or nosepiece, which includes only three major components, as such is less complicated to manufacture, assemble and repair compared to conventional nosepieces. A nosepiece body is securable to the tool and defines a fastener channel for receiving fasteners from the magazine and the driver blade from the power source. A unitary actuator reciprocates relative to the nosepiece and has a portion which directly engages the cage, thus significantly reducing the components required for performing the cage actuation function. Lastly, the pin guide serves as the WCE and reciprocates with the actuator. In addition, the pin guide extends into the fastener channel within the nosepiece body and is easily removable from the fastener channel without the use of tools using a push-and-twist motion. Thus, fastener jams are more easily cleared, and damaged WCE's are more readily replaced.

More specifically, a fastener-driving tool equipped with a fastener magazine is provided that includes a power source including a reciprocating driver blade for driving fasteners obtained from the magazine into a workpiece, and a reciprocating valve sleeve actuated by a cage, a nosepiece is provided, including a nosepiece body configured for attachment at one end to the fastener tool and defining a fastener channel constructed and arranged for receiving the driver blade and the fasteners sequentially fed by the magazine, the fastener channel having a fastener outlet. A tubular pin guide is disposed for reciprocal movement in the fastener channel for receiving fasteners traveling toward the outlet. A unitary actuator has a first end engaging the pin guide for common reciprocation relative to the nosepiece body and a second end engaging the cage.

In another embodiment, in a fastener-driving tool equipped with a fastener magazine is provided that includes a power source including a reciprocating driver blade for driving fasteners obtained from the magazine into a workpiece, and a reciprocating valve sleeve actuated by a cage, a nosepiece is provided including a nosepiece body configured for attachment at one end to the fastener tool and defining a fastener channel constructed and arranged for receiving the driver blade and the fasteners sequentially fed by the magazine, the fastener channel having a fastener outlet. A tubular pin guide is disposed for reciprocal movement in the fastener channel and for receiving fasteners traveling toward the outlet, the pin guide being removably engageable said fastener channel without the use of tools.

In yet another embodiment, a pin guide is provided for use in a nosepiece assembly in a fastener-driving tool equipped with a fastener magazine having a power source including a reciprocating driver blade for driving fasteners obtained from the magazine into a workpiece, and a reciprocating valve sleeve actuated by a cage, the tool including a nosepiece having a nosepiece body configured for attachment at one end to the fastener tool and defining a fastener channel constructed and arranged for receiving the driver blade and the fasteners sequentially fed by the magazine. The pin guide includes a tubular pin guide body defining an internal fastener passage, having a radially enlarged collar at an outlet end defining a shoulder for engaging an actuator, and at an end opposite the collar, being provided with a radial lip, and defining a recessed track for engaging a head of a fastener located in the fastener channel during installation of the pin guide in the channel in a push-and-twist motion. The track also slidably accommodates the fastener head through reciprocal action of the pin guide in the channel.

BRIEF DESCRIPTION OF THE DRAWINGS

FIG. 7 is a vertical section of the nosepiece showing the pin guide in an insertion orientation;

FIG. 8 is an end view of the nosepiece taken along the line 8-8 in FIG. 7 in the direction indicated;

FIG. 9 is a vertical section of the nosepiece showing the pin guide in a rotation orientation;

FIG. 10 is an end view of the nosepiece taken along the line 10-10 in FIG. 9 in the direction indicated;

FIG. 11 is a vertical section of the nosepiece showing the pin guide in a fully rotated operational position; and FIG. 12 is an end view of the nosepiece taken along the line 12-12 in FIG. 11 in the direction indicated.

DETAILED DESCRIPTION OF THE INVENTION

Figure 1:
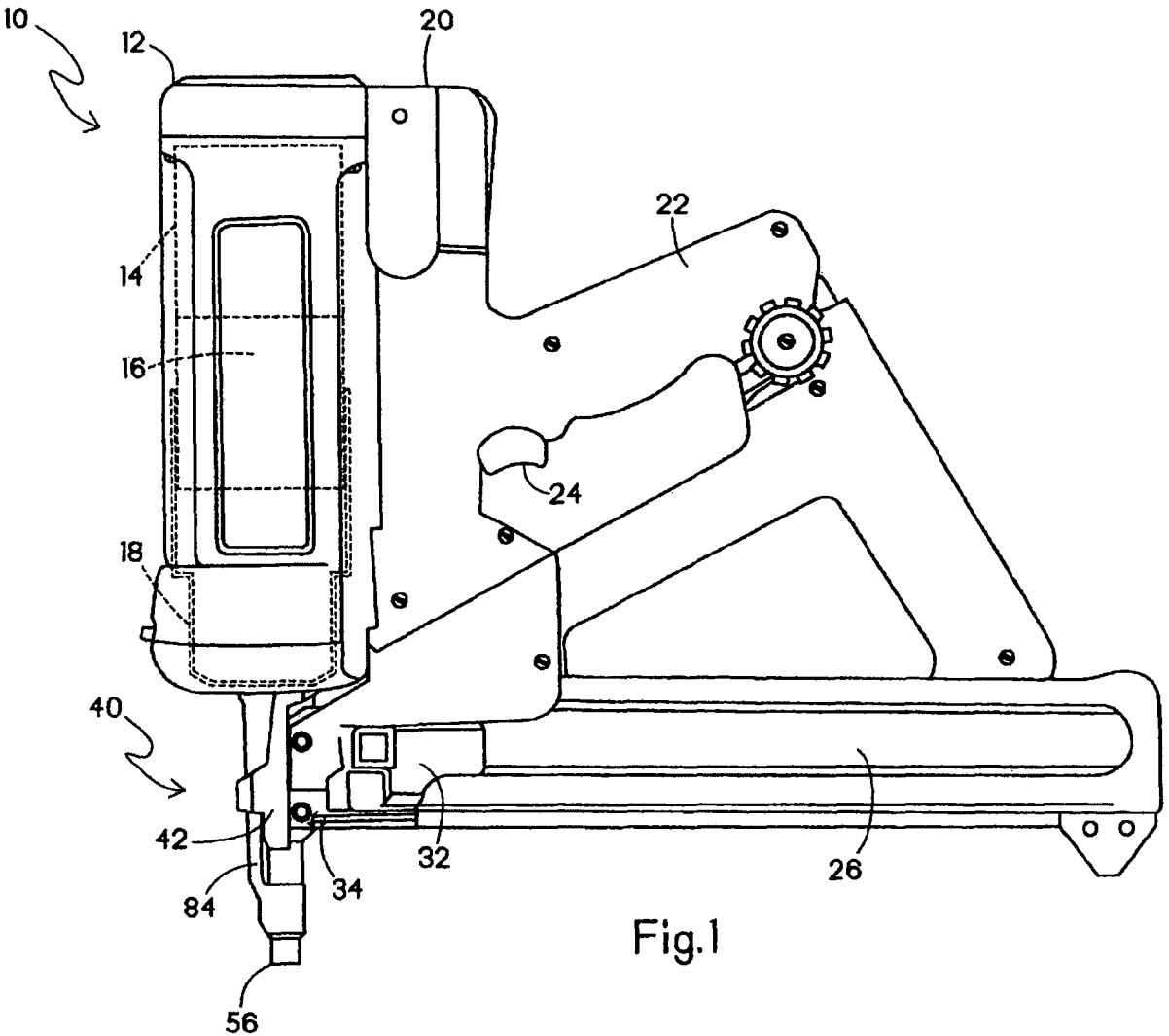
FIG. 1 is a side elevation of a fastener-driving tool equipped with the present nosepiece.

Referring now to FIG. 1, a fastener driving tool is designated generally at 10 and may be combustion-powered, pneumatic-powered or powder-activated; however, in the preferred embodiment a combustion-powered tool is depicted. Illustrated components of the tool 10 include a housing 12 enclosing a power source or engine 14 (shown hidden) which includes a reciprocating valve sleeve 16 moved by a cage 18 (FIG. 2) as is well known in the art. While a particular type of cage 18 has been depicted, it will be understood that the configuration of the cage may vary, and that it represents any structure which transfers linear motion from the actuator or WCE to the valve sleeve 16 for cyclically closing the combustion chamber. A fuel cell door 20 provides access to a fuel cell compartment housing a fuel cell (not shown) which provides fuel to the power source 14.

Included on the housing 12 is a handle 22 provided with a trigger or trigger switch 24 which initiates ignition in the power source 14. A magazine 26 retains a supply of fasteners 28 (FIG. 3), which may assume various shapes and types as known, but in the preferred embodiment are collated pins each inserted into a plastic sleeve 30 of the type described in commonly-assigned U.S. Pat. Nos. 6,641,021 and 6,892,922 which are incorporated by reference. The magazine 26 includes a spring-loaded follower 32 with a forward-projecting extension 34 which, when it engages a nose assembly or nosepiece 40 as described below, will indicate that only a few fasteners 28 remain in the magazine and will disable the tool, to prevent firing with an empty magazine.

Other components of the fastener-driving tool 10 are not critical to this invention and may be well known components of such a tool. Suitable combustion-powered, fastener-driving tools are available from ITW-Ramset (a unit of Illinois Tool Works, Inc.) of Glendale Heights, Ill., under its TRAK-FAST® trademark, into which these components can be readily incorporated. Such combustion-powered tools are similar to the tools disclosed in U.S. Pat. Nos. 4,403,722; 4,483,280; 4,483,474; 4,483,474; 4,522,162; 5,263,439 and Re. 32,452; all of which are incorporated by reference.

Figure 2:
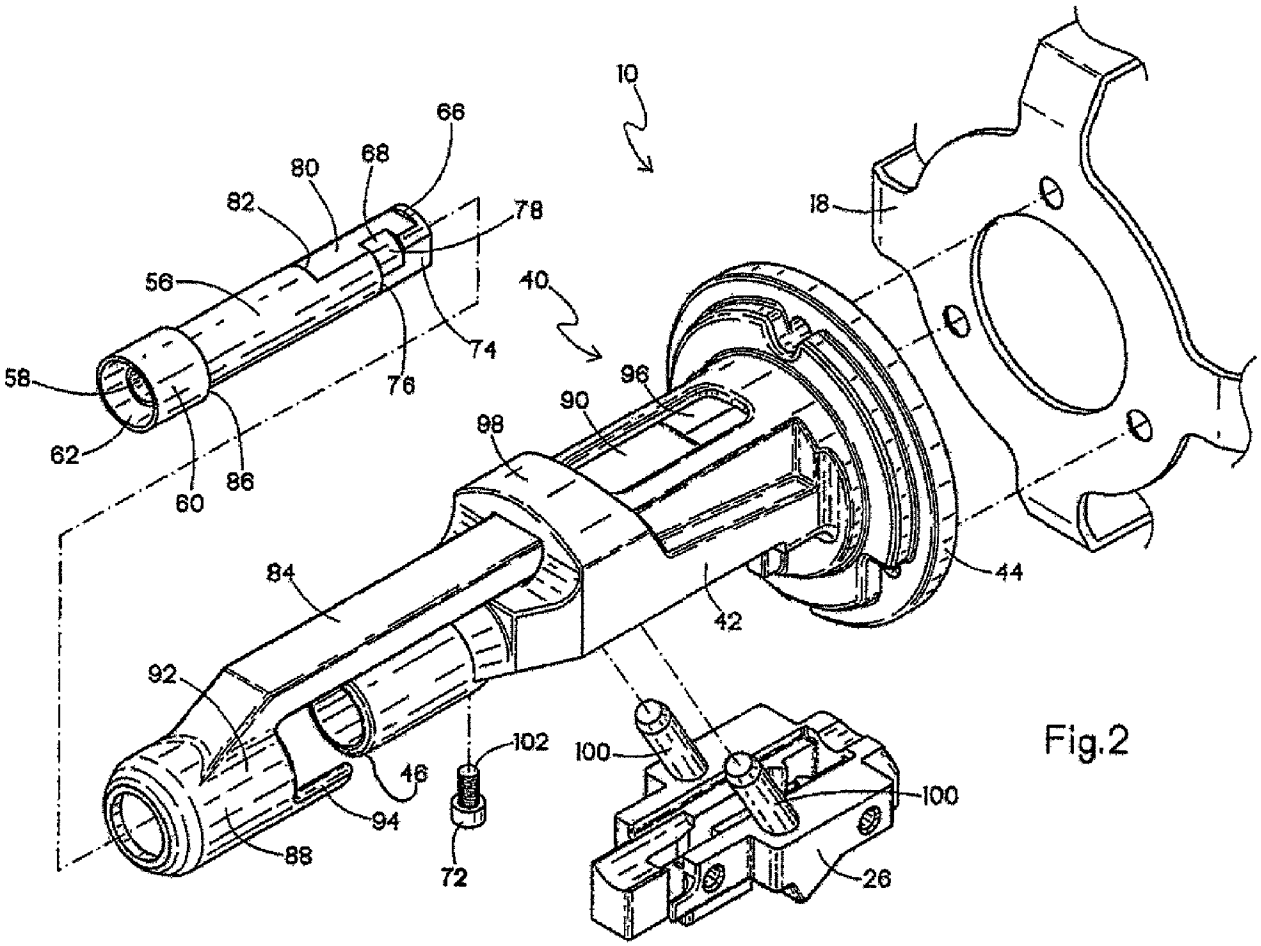
FIG. 2 is an exploded perspective view of the present nosepiece.
Figure 3:
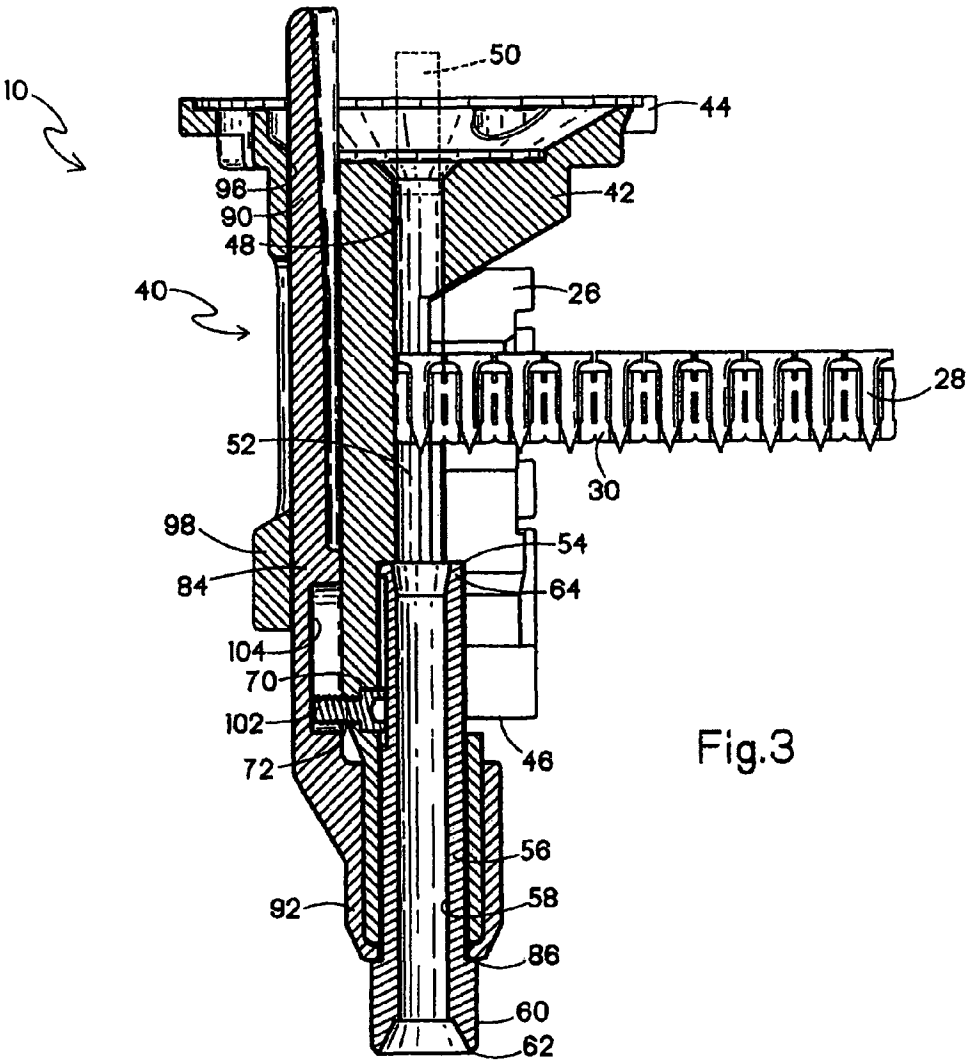
FIG. 3 is a vertical section of the present assembled nosepiece.
Figure 6:
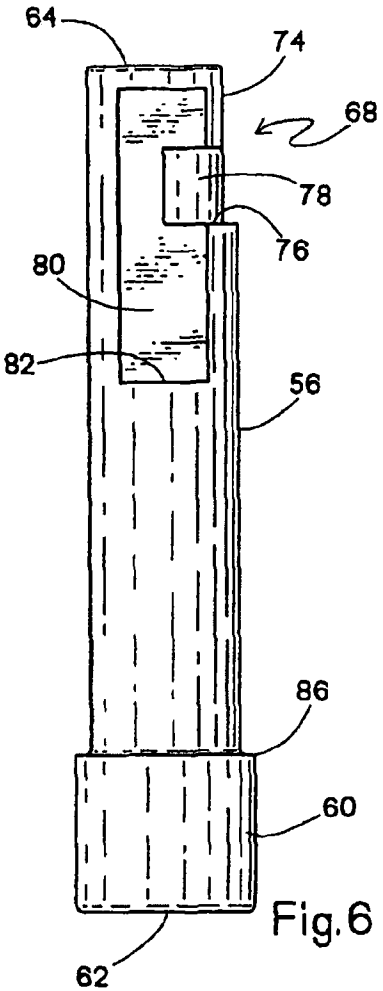
FIG. 6 is an overhead plan view of the present pin guide.
Figure 5:
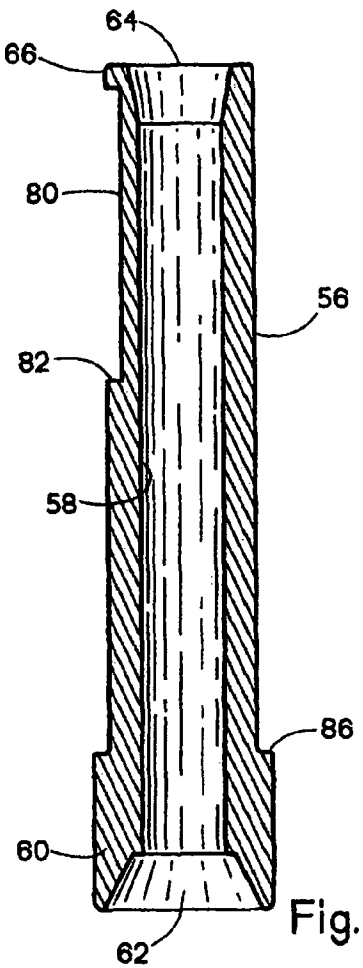
FIG. 5 is a vertical section of the pin guide of FIG. 4.
Figure 4:
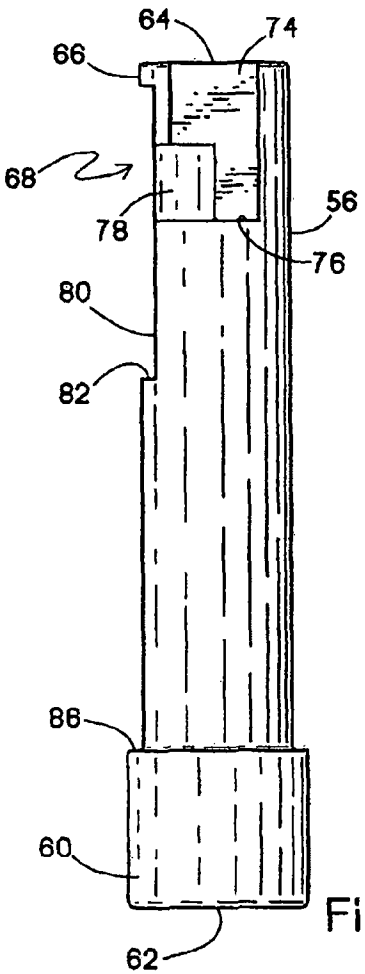
FIG. 4 is a side elevation of the present pin guide.

Referring now to FIGS. 2 and 3, the nosepiece 40 includes a nosepiece body 42 configured for attachment at a flanged end 44 to the tool 10, and more preferably to a lower end of the power source 14. In the preferred embodiment, the nosepiece body 42 is a unitary member formed by casting and made of steel; however other metals or engineered materials and fabrication techniques are contemplated. Opposite the flanged end 42 is a fastener outlet 46. Between the flanged end 44 and the fastener outlet 46 is defined a generally cylindrical fastener channel 48. Dimensioned to slidingly accommodate a driver blade 50 (shown in phantom) from the power source 14, as well as a fastener 28 and the associated sleeve 30 sequentially fed from the magazine 26, the fastener channel 48 includes a first or upper portion 52 having a relatively smaller diameter, and a second or lower portion 54 defining a pin guide chamber and including the outlet 46.

Also included on the nosepiece 40 is a pin guide 56 which is tubular, is inserted into the outlet 46 to line the lower portion 54 of the fastener channel 48 and defines a fastener passage 58. Thus, the pin guide functions as a guide for the fasteners 28 as they are driven through the outlet. Also, the pin guide 56 is provided with a radially enlarged collar 60 at an outlet end 62 which serves as the work contact element (WCE) of the nosepiece 40.

Referring now to FIGS. 2 and 4-6, at an end 64 opposite the collar 60, the pin guide 56 is provided with a radial lip 66, and defines a recessed, generally "L"-shaped track 68. The track 68 is configured for engaging a head 70 of a guide fastener 72 located in the fastener channel 48 during installation of the pin guide 56 in the channel in a push-and-twist motion. Once installed, the track 68 slidably accommodates the fastener head 70, which at least partly projects into the fastener channel 48, during reciprocal action of the pin guide 56 relative to the nosepiece body 42. Engagement between the radial lip 66 and the fastener head 70 retains the pin guide 56 within the lower portion 54 of the fastener channel 48 once the pin guide has been rotated to its operational position.

More specifically, and referring now to FIGS. 2 and 4-6, the generally "L"-shaped track 68 includes a first entry flat spot 74 which lacks the lip 66 and is used to align the pin guide 56 with the fastener head 70 upon insertion of the pin guide into the fastener channel 48. A stop 76 at an end of the flat spot 74 creates a tactile sensation which indicates to the user to rotate the pin guide 90°. An arcuate, recessed portion 78 of the track 68 accommodates the fastener head 70 during this rotation. The arcuate recessed portion 78 is in communication with the flat spot 74. A reciprocating flat spot 80 is in communication with the arcuate recessed portion 78 and is defined between the lip 66 and an arcuate wall 82. The reciprocating flat spot 80 is significantly longer than, and is generally parallel to the entry flat spot 74. The recessed portion 78 is disposed perpendicularly to the flat spots, 74 and 80.

A third major component of the nosepiece 40 is an actuator 84 which reciprocates relative to the nosepiece body 42 with the pin guide 56. The actuator 84 is preferably unitary, being cast from a metal such as steel, or equivalent metal; however forging, machining or other fabricating techniques are contemplated. This unitary construction is an advance over corresponding prior art structures, which were typically provided in multiple components secured together with fasteners and as such being more easily damaged and more tedious to repair and/or replace. The radially enlarged collar 60 defines a shoulder 86 for engaging a first end 88 of the actuator 84 for common reciprocal movement relative to the nosepiece body 42. Opposite the first end 88, a second end 90 engages the cage 18 and forms a barrel 92.

Projecting from the barrel 92, the second end 90 is actually an elongate arm or rod sufficiently robust to directly contact the cage 18 and to overcome a spring biasing force acting on the valve sleeve 16 to move the valve sleeve so as to close the tool combustion chamber (not shown) as is well known in the art and described in further detail in the patents incorporated by reference above. While other shapes are contemplated, the second end 90 is preferably rectangular in cross-section to provide a sufficient contact surface for actuating the cage 18, and also is preferably solid to withstand the significant shock impact forces generated during tool operation.

Dimensioned to slidingly accommodate the pin guide 56, the first end 88 defines the tubular barrel 92 with a tab 94 constructed and arranged for receiving the magazine follower extension 34 when the magazine has only a few remaining fasteners. Contact between the extension 34 and the tab 94 prevents further reciprocation of the actuator 84 relative to the nosepiece body 42 and as such prevents tool firing until the magazine 26 is reloaded.

Referring now to FIGS. 2 and 3, the nosepiece body 42 defines a track 96 for slidably receiving the reciprocating actuator 84. The track 96 is preferably an integral component of the nosepiece body 42, and includes a bridge formation 98 which prevents movement of the second end 90 from the track 96. In the preferred embodiment, the bridge formation 98 also supports and encloses magazine locator pins 100 which facilitate location and engagement of the magazine 26 with the nosepiece 40. Further guiding of the actuator 84 is provided by a tip 102 of the guide fastener 72, which upon full installation projects through the nosepiece body 42 and is received in an axially extending guide slot 104. It will be understood that the guide slot 104 is at least as long as the travel of the actuator 84 and the pin guide 56 relative to the nosepiece body between a rest position (FIG. 7) and a prefiring position (FIG. 3). In the prefiring position, the actuator 84 has reached the full extent of reciprocal movement. As such, the second end 90 has engaged and pushed the cage 18 to move the valve sleeve 16 to close the combustion chamber, as is well known in the combustion tool art.

Referring now to FIGS. 7-12, the push-and-twist installation of the pin guide 56 into the nosepiece body 42 without the use of tools is shown in sequence. More specifically referring to FIGS. 7 and 8, the pin guide 56 is oriented so that the entry flat spot 74 is aligned with the head 70 of the guide fastener 72. In this position, the flat spot 74 is seen by the user as facing towards the bridge formation 98. Once aligned, the pin guide 56 is inserted axially into the fastener channel 48 until the fastener head contacts the stop 76.

Referring now to FIGS. 9 and 10, upon contact with the stop 76, which is sensed by the user, the pin guide 56 is then rotated axially 90° or a quarter turn, so that the fastener head 70 follows the arcuate recessed portion 78 until it reaches the reciprocating flat spot 80.

Referring now to FIGS. 11 and 12, the pin guide 56 is now oriented so that the fastener head 70 is aligned with the reciprocating flat spot 80. In this orientation, the pin guide 56 is retained in position relative to the nosepiece body 42 by the radial lip 66, which acts as a stop, preventing axial withdrawal of the pin guide from the nosepiece body 42. Removal of the pin guide to remove a jammed fastener 28 or to replace the pin guide is performed in the reverse sequence.

It will be seen that the present nosepiece 40 provides for more efficient operation in that there are fewer component parts than in the prior units. Pin or fastener jams can be more easily cleared without the use of tools by easily removing the pin guide 56. Also, the unitary construction of the actuator 84 provides for positive actuation of the cage 18 and enhances resistance to operation-generated impact forces.

While specific embodiments of the present nose assembly for a fastener driving tool have been shown and described, it will be appreciated by those skilled in the art that changes and modifications may be made thereto without departing from the invention in its broader aspects and as set forth in the following claims.

What is claimed is:

1. In a fastener-driving tool equipped with a fastener magazine, having a power source including a reciprocating driver blade for driving fasteners obtained from said magazine into a workpiece, and a reciprocating valve sleeve actuated by a cage, a nosepiece comprising:

a nosepiece body configured for attachment at one end to said fastener tool and defining a fastener channel constructed and arranged for receiving said driver blade and said fasteners sequentially fed by said magazine, said fastener channel having a fastener outlet;

a tubular pin guide disposed for reciprocal movement in said fastener channel and defining an internal passage for receiving fasteners traveling toward said outlet;

a unitary actuator having an outer surface, an inner surface, a first end engaging said pin guide for common reciprocation relative to said nosepiece body, a second end directly engaging said cage and a recessed guide slot defined solely by said inner surface and extending along a longitudinal axis of said actuator;

an independent guide fastener enclosed by said nosepiece body and including a first end and an opposing second end, said first end at least partially projecting into said fastener channel and slidably engaging an outside surface of said pin guide for retaining said pin guide in said nosepiece, and said second opposing end projecting into said guide slot and being slidable in said guide slot along said longitudinal axis and within said actuator while axially retaining said actuator on said nosepiece.

2. The nosepiece of claim 1 wherein said fastener channel has a first diameter portion for receiving said fasteners and said driver blade, a second diameter portion for receiving said pin guide, and a stop at an end of said second portion for limiting reciprocal movement of said pin guide.

3. The nosepiece of claim 1 wherein said pin guide has a radially enlarged collar defining a shoulder for engaging said first end of said actuator.

4. The nosepiece of claim 1 wherein said pin guide is removable from said nosepiece body without the use of tools by rotating said pin guide out of engagement with said first end of said guide fastener.

5. The nosepiece of claim 4 said pin guide has a fastener receiving end configured for engaging said first end so that upon a push-and-twist motion of said pin guide, said fastener receiving end is retained in said fastener channel, said fastener receiving end is provided with a radially extending lip and is retained in said fastener channel through engagement of said radially extending lip and said first end, and said pin guide defines a recessed track for slidably accommodating said first end through reciprocal action of said pin guide in said channel, said track including an interruption in said lip for permitting disengagement of said pin guide from said nosepiece without the use of tools.

6. The nosepiece of claim 1 wherein said nosepiece body defines a track for slidably retaining said second end of said actuator.

7. The nosepiece of claim 1 wherein said actuator first end is provided with a tab for receiving a magazine follower to disable tool operation when a limited number of said fasteners remain in said magazine.

8. In a fastener-driving tool equipped with a fastener magazine, having a power source including a reciprocating driver blade for driving fasteners obtained from said magazine into a workpiece, and a reciprocating valve sleeve actuated by a cage, a nosepiece comprising:

a nosepiece body configured for attachment at one end to said fastener tool and defining a fastener channel constructed and arranged for receiving said driver blade and said fasteners sequentially fed by said magazine, said fastener channel having a fastener outlet; and a tubular pin guide disposed for reciprocal movement in said fastener channel and defining an internal passage for receiving fasteners traveling toward said outlet;

a guide fastener enclosed by said nosepiece body, having a head at least partially projecting into said fastener channel, and said pin guide having an outer surface and a fastener receiving end provided with a lip radially projecting from said outer surface, said head slidably engaging said outer surface of said pin guide and being retained in said fastener channel through engagement with said lip, said outer surface defining a track with a flat spot lacking said lip, so that upon a push-and-twist motion of said pin guide, said fastener receiving end is disengaged from said head, and said pin guide is removable from said fastener channel without the use of tools.

9. The nosepiece of claim 8 wherein said channel defines a pin guide chamber dimensioned for accommodating reciprocal movement of said pin guide relative to said nosepiece body, and said pin guide chamber includes a stop limiting movement of said pin guide.

10. The nosepiece of claim 8 wherein said track has axially and laterally extending portions for engaging said head during installation of said pin guide in said channel, and said track also slidably accommodating said head through reciprocal action of said pin guide in said channel.

11. The nosepiece of claim 8 further including an actuator configured for engaging said pin guide for common reciprocation relative to said nosepiece body and also for engaging said cage.

12. A pin guide for use in a nosepiece assembly in a fastener-driving tool equipped with a fastener magazine, having a power source including a reciprocating driver blade for driving fasteners obtained from the magazine into a workpiece, and a reciprocating valve sleeve actuated by a cage, the tool including a nosepiece having a nosepiece body configured for attachment at one end to the fastener tool and defining a fastener channel constructed and arranged for receiving the driver blade and the fasteners sequentially fed by the magazine, said pin guide comprising:

a tubular pin guide body defining an internal fastener passage, having a radially enlarged collar at an outlet end defining a shoulder for engaging an actuator, and at an end opposite said collar, having an outer surface and being provided with a lip radially projecting from said outer surface, said outer surface defining a first track for engaging a head of a guide fastener enclosed by the nosepiece body and located in the fastener channel during installation and removal of said pin guide in said channel in a push-and-twist motion, said first track including a first end and a second end, said first end having a flat spot interrupting said lip and said second end including a recessed portion, a second L-shaped track is positioned adjacent to said recessed portion for respectively accommodating said push-and-twist motion and slidably accommodating the fastener head in said first track and said second track and through reciprocal action of said pin guide in said channel.

13. The pin guide of claim 12 wherein said pin guide is retained in the fastener channel through engagement of said lip and the head.

* * * * *